US008696082B2

(12) United States Patent
Loper et al.

(10) Patent No.: US 8,696,082 B2
(45) Date of Patent: Apr. 15, 2014

(54) COUNTERACTING EXPANSION EFFECTS OF MOISTURE ON MEDIA WITHIN FLUID-EJECTION DEVICE

(75) Inventors: Whitney Elaine Loper, Corvallis, OR (US); Timothy Jay Bouma, Corvallis, OR (US); Ryan Newman, San Diego, CA (US); Joseph W. Stellbrink, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 166 days.

(21) Appl. No.: 13/260,216

(22) PCT Filed: Apr. 15, 2009

(86) PCT No.: PCT/US2009/040729

§ 371 (c)(1), (2), (4) Date: Sep. 23, 2011

(87) PCT Pub. No.: WO2010/120299

PCT Pub. Date: Oct. 21, 2010

(65) Prior Publication Data

US 2012/0026233 A1 Feb. 2, 2012

(51) Int. Cl.
*B41J 29/38* (2006.01)
*B41J 2/01* (2006.01)

(52) U.S. Cl.
USPC ..... 347/16; 347/101; 347/102

(58) Field of Classification Search
USPC ..... 347/8, 16, 101, 102
See application file for complete search history.

(56) References Cited

U.S. PATENT DOCUMENTS

| | | | | |
|---|---|---|---|---|
| 2004/0008230 | A1* | 1/2004 | Kelley et al. | 347/8 |
| 2009/0073211 | A1* | 3/2009 | Imoto | 347/16 |
| 2009/0122126 | A1* | 5/2009 | Ray et al. | 347/102 |

* cited by examiner

*Primary Examiner* — Jason Uhlenhake

(57) ABSTRACT

Expansion effects of moisture on media resulting from ejection of fluid by the fluid-ejection device onto the media within a print zone in accordance with a portion of a print job are inferred. In response to inferring the expansion effects of moisture on the media, an action is performed to counteract the expansion effects of moisture on the media.

14 Claims, 7 Drawing Sheets

COUNTERACTING EXPANSION EFFECTS OF MOISTURE ON MEDIA WITHIN FLUID-EJECTION DEVICE

BACKGROUND

A fluid-ejection device is a type of device that ejects fluid in a controlled manner. For example, one type of fluid-ejection device is an inkjet-printing device, in which ink is ejected onto media to form an image on the media. Furthermore, a roller-based fluid-ejection device includes fluid-ejection mechanisms, such as printheads, that eject fluid onto media as the media moves past a series of rollers.

DETAILED DESCRIPTION

Overview of Problem and Solution

Figure 1:
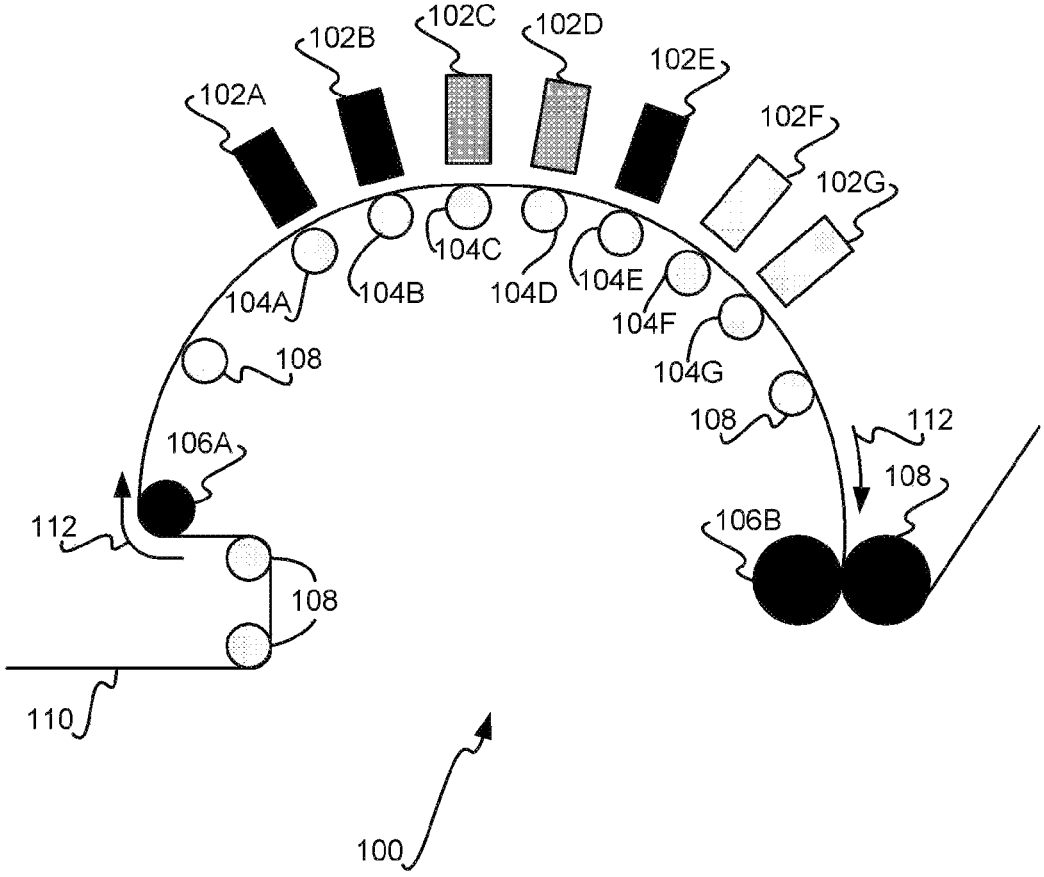
FIG. 1 is a diagram of a representative roller-based fluid-ejection device, according to an embodiment of the present disclosure.

As noted in the background, a roller-based fluid-ejection device ejects fluid onto media as the media moves past a series of rollers. Ejection of fluid onto the media results in moisture being applied to the media. The inventors have recognized that such moisture can affect the properties of the media, and particularly cause the media to expand. The inventors have further recognized that such media expansion can be detrimental to optimal image formation resulting from fluid ejection on the media, and can also cause problems within the roller-based fluid-ejection device itself.

For example, the media can expand along the surface of the media on which fluid is ejected. That is, the media can expand along this surface in a direction parallel to the direction in which the media is rolled through the fluid-ejection device, as well as in a direction perpendicular to the direction in which the media is rolled through the fluid-ejection device. Such media expansion is disadvantageous, because it can result in fluid being ejected onto the media at unintended locations, because the intended locations of fluid ejection have in effect moved due to the media expanding or stretching.

As another example, the media can expand perpendicular to the surface of the media on which fluid is ejected. That is, the media can wrinkle or cockle, resulting in the media moving towards the fluid-ejection mechanisms that eject fluid onto the media. Such media wrinkling or cockling is disadvantageous, because it can result in the media coming into contact with the fluid-ejection mechanisms, which is problematic at best because image quality can be affected and at worst because the mechanisms can be damaged.

The inventors have novelly and inventively at least substantially overcome the problems associated with the expansion effects of moisture on media resulting from ejecting fluid onto the media within a fluid-ejection device. In particular, the inventors have inventively determined that actions can be performed to counteract the expansion effects of moisture on the media. As a first example, the tension of the media is innovatively adjusted while the media is being rolled within the fluid-ejection device to minimize the expansion effects of moisture on the media. As a second example, the spacing between a selected fluid-ejection mechanism and a selected roller of the fluid-ejection device is innovatively adjusted to maintain a minimal distance between the selected mechanism and the media while preventing the selected mechanism from contacting the media due to the expansion effects of moisture on the media.

As such, the problems associated with the expansion effects of moisture on media are at least substantially minimized. First, fluid is less likely to be ejected onto the media at unintended locations due to the intended locations of fluid ejection having effectively moved due to media expansion or stretching, because these expansion effects are minimized. Second, the media is less likely to come into contact with fluid-ejection mechanisms due to media wrinkling or cockling, because the mechanisms are moved away from their corresponding rollers while still maintaining a desired minimal distance between the mechanisms and the media.

The inventors' novel approach to at least substantially overcome the problems associated with the expansion effects of moisture on media resulting from ejecting fluid onto the media within a fluid-ejection device also at least substantially mitigates other effects resulting from ejecting fluid onto media within such a fluid-ejection device. For instance, the physical properties of some types of media, such as paper, change as fluid is ejected onto the media. An example of such a physical property is elastic modulus. The elastic modulus of a medium is a mathematical description of the medium's tendency to be deformed elastically (i.e., non-permanently) when a force is applied to it. The approaches that the inventors have developed to at least substantially overcome the expansion effects of moisture on media resulting from ejecting fluid onto the media thus can also mitigate changes within the elastic modulus of the media itself, as well as other physical properties of the media.

Representative Roller-Based Fluid-Ejection Device

FIG. 1 shows a representative roller-based fluid-ejection device 100, according to an embodiment of the disclosure. The fluid-ejection device 100 is a roller-based fluid-ejection device because it employs a series of rollers past which media 110, such as paper, moves through the device 100. The fluid-ejection device 100 can be an inkjet-printing device, like an inkjet printer, or another type of fluid-ejection device.

The fluid-ejection device 100 includes fluid-ejection mechanisms 102A, 102B, 102C, 102D, 102E, 102F, and 102G, collectively referred to as the fluid-ejection mechanisms 102. The fluid-ejection mechanisms 102 are each capable of ejecting fluid, and may also be referred to as printheads. In one embodiment, the fluid-ejection mechanisms 102A and 1028 may eject black fluid, the mechanisms 102C and 102D may eject cyan fluid, the mechanism 102E may eject magenta fluid, and the mechanisms 102F and 102G may eject yellow fluid.

The fluid-ejection device 100 includes rollers 104A, 104B, 104C, 104D, 104E, 104F, and 104G, collectively referred to as the rollers 104, and which correspond to the fluid-ejection mechanisms 102. The rollers 104 are capable of rolling as the media 110 moves past the rollers 104. The space between each roller and a corresponding fluid-ejection mechanisms defines a print zone therebetween within which the fluid-ejection mechanism in question ejects fluid onto a portion of the media 110 as the media 110 moves through the print zone. For example, the fluid-ejection mechanism 102A and the roller 104A define a first print zone, the mechanism 102B and the roller 104B define a second print zone, the mechanism 102C and the roller 104C define a third print zone, and so on.

The fluid-ejection device 100 includes drive rollers 106A and 106B, collectively referred to as the drive roller 106. The drive rollers 106 are coupled to motors to rotate the drive rollers 106. By comparison, the rollers 104 are typically not coupled to motors, but rather rotate due to the media 110 moving past them, where the media 110 itself moves due to the rotation of the drive rollers 106. As such, the drive rollers 106 are motorized, whereas the roller 104 are unmotorized. The drive rollers 106 can rotate at different rotational speeds. The drive rollers 106 are thus the mechanism by which the media 110 is moved through the fluid-ejection device 100. The fluid-ejection device 100 can include other components, in addition to the fluid-ejection mechanisms 102, the rollers 104, and the drive rollers 106. For instance, as depicted in FIG. 1, the fluid-ejection device 100 may include other rollers 108 to guide the media 110 through the device 100.

During operation of the fluid-ejection device 100, the media 110 is moved through the device 100 in the direction indicated by arrows 112 in FIG. 1. As the media 110 is moved through each print zone, the fluid-ejection mechanism of that print zone ejects fluid onto the media 110 in accordance with a portion of a print job. For example, the fluid-ejection mechanisms 102 may eject fluid onto the media 110 to form a desired image on the media 110. The desired image corresponds to the print job, and may include text and/or graphics.

Moisture-Related Expansion Effects

Figure 2:
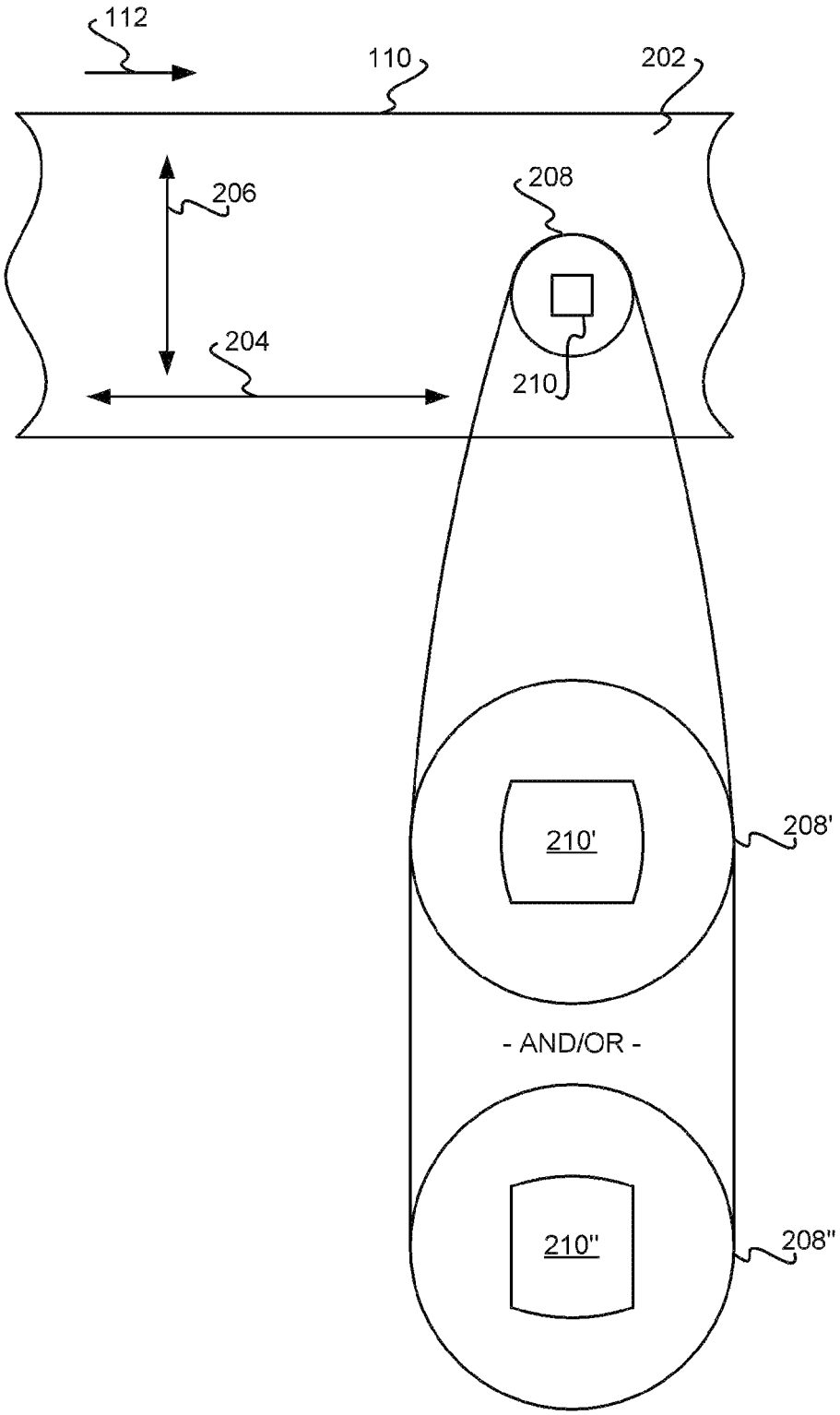
FIG. 2 is a diagram depicting two types of moisture-related expansion effects on media, according to an embodiment of the present disclosure.

As described above, the ejection of fluid by the roller-based fluid-ejection device 100 onto the media 110 results in moisture being applied to the media 110. This moisture can cause expansion effects, such that the media 110 expands. FIG. 2 shows two types of such moisture-related expansion effects, according to an embodiment of the disclosure. In FIG. 2, the surface 202 of the media 110 on which fluid is ejected by the fluid-ejection device 100 is depicted. The media 110 moves through the fluid-ejection device 100 as indicated by the arrow 112.

Fluid ejected onto the surface 202 of the media 110 can cause expansion of the media 110 along the surface 202. The first type of moisture-related expansion effect is thus expansion of the media 110 in a direction indicated by the arrow 204, parallel to the direction of movement of the media 110 within the fluid-ejection device 100 as indicated by the arrow 112, and parallel to the surface 202 of the media 110. For example, an unexpanded square portion 210 of the media 110, as indicated by the reference number 208, is considered. Expansion of the media 110 in the direction indicated by the arrow 204 results in the square portion 210 expanding in this direction, as denoted as the expanded portion 210' as indicated by the reference number 208'. In particular, the expanded portion 210' expands, or bows out, along the direction indicated by the arrow 204, as compared to the unexpanded square portion 210.

The second type of moisture-related expansion effect is expansion of the media 110 in a direction indicated by the arrow 206, perpendicular to the direction of movement of the media 110 within the fluid-ejection device 100 as indicated by the arrow 112, and parallel to the surface 202 of the media 110. For example, the unexpanded square portion 210 of the media 110, as indicated by the reference number 208, is again considered. Expansion of the media 110 in the direction indicated by the arrow 206 results in the square portion 210 expanding in this direction, as denoted by the expanded portion 210" as indicated by the reference number 208". In particular, the expanded portion 210" expands, or bows out, along the direction indicated by the arrow 204, as compared to the unexpanded square portion 210. It is noted that either or both of these two types of moisture-related expansion effects can occur as a result of moisture being applied to the media 110.

Figure 3:
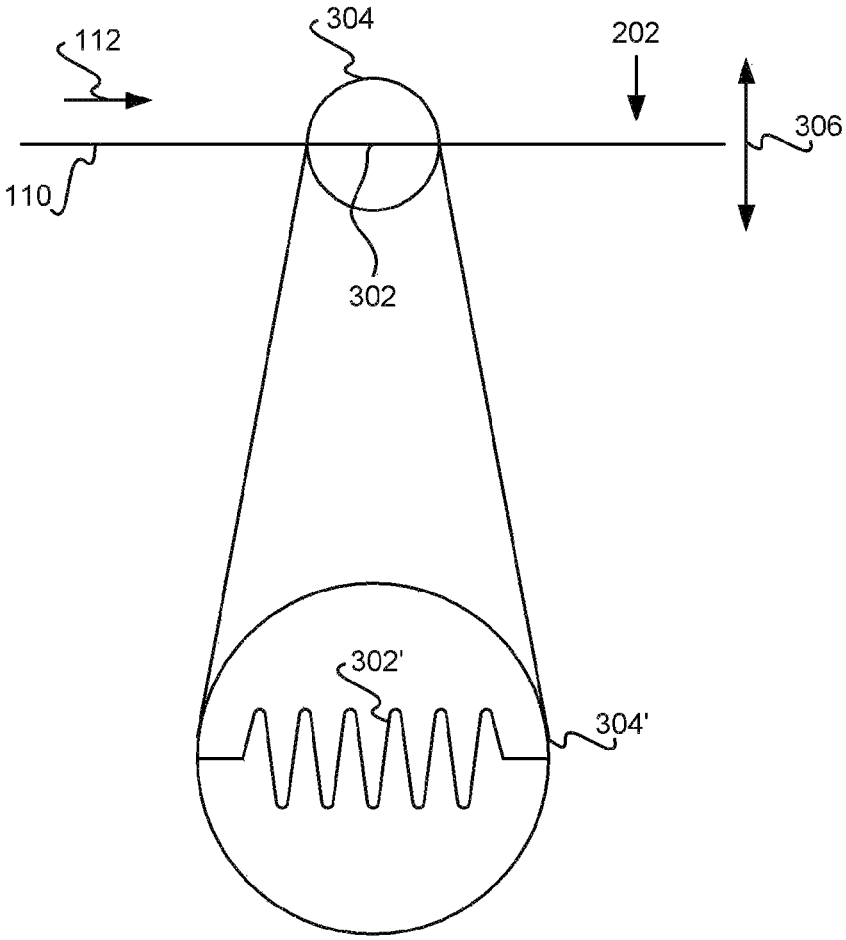
FIG. 3 is a diagram of a third type of moisture-related expansion effect on media, according to an embodiment of the present disclosure.

FIG. 3 shows a third type of moisture-related expansion effect, according to an embodiment of the disclosure. In FIG. 3, the surface 202 of the media 110 on which fluid is ejected by the fluid-ejection device 100 is again depicted. The media 110 moves through the fluid-ejection device 100 as indicated by the arrow 112. Fluid ejected onto the surface 202 of the media 110 can cause expansion of the media 110 in a direction, indicated by arrow 306, which is perpendicular to the direction of movement of the media 110 as indicated by the arrow 112, and perpendicular to the surface 202 of the media 110.

For example, an unexpanded portion 302 of the media 110, as indicated by the reference number 304, is considered. Expansion of the media 110 in the direction indicated by the arrow 306 results in the portion 302 expanding in this direction, as denoted by the expanded portion 302' as indicated by the reference number 304'. In particular, the portion 302' wrinkles, or cockles, along the direction indicated by the arrow 306. Such wrinkling or cockling is a third type of moisture-related expansion effect.

First Innovative Approach to Counteracting Moisture-Related Expansion Effects

In this section of the detailed description, the first innovative approach to counteracting moisture-related expansion effects as developed by the inventors is described. In particular, the tension of the media 110 while the media 110 is being rolled through the roller-based fluid-ejection device 100 is adjusted. The inventors have novelly determined that such tension adjustment minimizes the expansion of the media 110 that results from ejecting fluid onto the media 110 within a print zone.

In one embodiment, the tension of the media 110 is adjusted by adjusting the rotational speed of the drive roller 1068 of FIG. 1 in relation to the rotational speed of the drive roller 106A of FIG. 1, although in other embodiments, the tension may be adjusted in other ways, in addition to and/or in lieu of adjusting the relative rotational speeds of the drive rollers 106. It is noted that the drive roller 106B is located within the fluid-ejection device 100 after the media has had fluid ejected thereon within the device 100. By comparison, the drive roller 106A is located within the device 100 before the media has had fluid ejected thereon within the device 100.

The tension of the media 110 may be decreased or increased. Decreasing the tension of the media 110 is achieved by decreasing the rotational speed of the drive roller 106B in relation to the rotational speed of the drive roller 106A. For example, the rotational speed of the drive roller 106B may be decreased while the rotational speed of the drive roller 106A is kept constant. As another example, the rotational speed of the drive roller 106A may be increased while the rotational speed of the drive roller 106B is kept constant.

Increasing the tension of the media 110 is achieved by increasing the rotational speed of the drive roller 106B in relation to the rotational speed of the drive roller 106A. For example, the rotational speed of the drive roller 106B may be increased while the rotational speed of the drive roller 106A is kept constant. As another example, the rotational speed of the drive roller 106A may be decreased while the rotational speed of the drive roller 106B is kept constant.

Second Innovative Approach to Counteracting Moisture-Related Expansion Effects

In this section of the detailed description, the second innovative approach to counteracting moisture-related expansion effects as developed by the inventors is described. In particular, the spacing between a selected fluid-ejection mechanism and its corresponding selected roller is adjusted to maintain a minimal distance between the mechanism and the media 110, while preventing the selected mechanism from contacting the media 110 due to expansion of the media 110. The spacing is adjustable because the selected fluid-ejection mechanism is movably adjustable towards and away from its corresponding selected roller; that is, the selected fluid-ejection mechanism is movable towards and away from its corresponding selected roller. The inventors have novelly determined that such spacing adjustment can prevent undesirable fluid-ejection mechanism/media contact, while at the same time at least substantially ensuring that optimal quality fluid ejection by the fluid-ejection mechanism onto the media 110 is achieved by maintaining a desired minimal distance between the mechanism and the media 110.

Figure 4A:
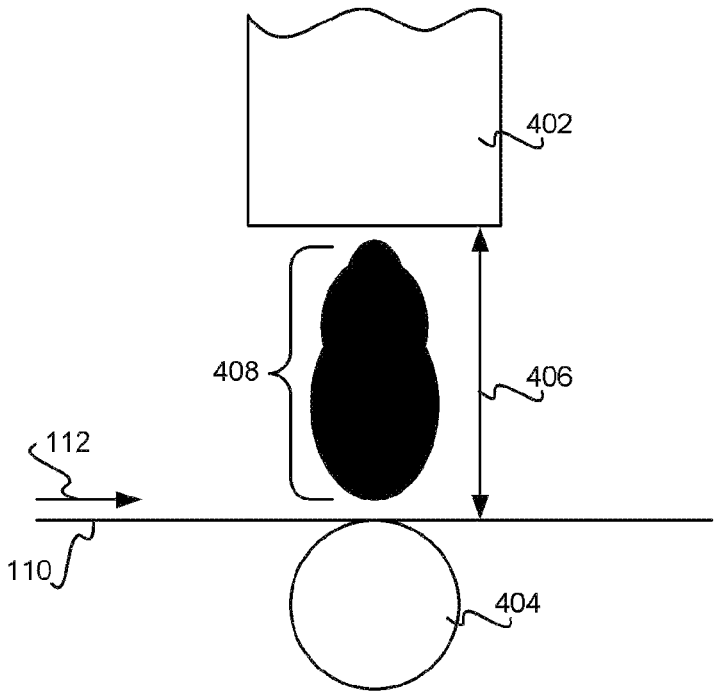
FIGS. 4A and 4B are diagrams depicting the desirability of maintaining a minimal distance between a fluid-ejection mechanism and media, according to an embodiment of the present disclosure.
Figure 4B:
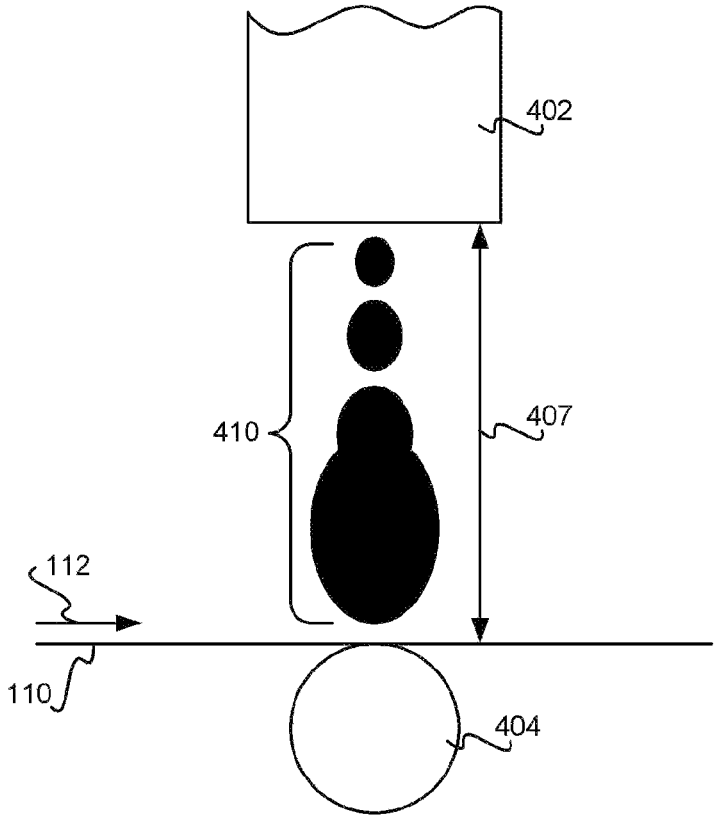

FIGS. 4A and 4B show why maintaining a desired minimal distance between a selected fluid-ejection mechanism 402 and the media 110 optimizes fluid-ejection quality by the mechanism 402, according to an embodiment of the disclosure. In FIGS. 4A and 4B, the fluid-ejection mechanism 402 has a corresponding roller 404, between which the media 110 is moved. As such, the fluid-ejection mechanism 402 may be selected from the fluid-ejection mechanisms 102, and the roller 404 may be selected from the rollers 104. As one example, the fluid-ejection mechanism 402 may be the fluid-ejection mechanism 102F and the roller 404 may be the roller 104F.

It is noted that a given fluid drop is not ejected by the fluid-ejection mechanism 402 as a single spherical drop, but rather as a main drop, followed by some additional amount of fluid, which is referred to as a tail. This secondary tail may have a different velocity than the main drop, and may land at a different location than the main drop, at least in part because the media 110 is moving while the fluid drop is being ejected. Therefore, maintaining a desired minimal distance between the fluid-ejection mechanism 402 and the media 110 ensures that the entire fluid drop lands as much as possible at the same location, thus maximizing quality of the printed image.

In relation to FIGS. 4A and 4B, the fluid-ejection mechanism 402 is separated by distances 406 and 407 from the media 110, respectively, where the distance 406 in FIG. 4A is smaller than the distance 407 in FIG. 4B. As such, printed image quality is more optimal in FIG. 4A, because all portions of the fluid drop 408 are likely to land as much as possible at the same location. By comparison, printed image quality is less optimal in FIG. 4B, because not all portions of the fluid drop 410 are likely to land as much as possible at the same location. This is because the media 110 is moving from left to right as indicated by arrow 112 in FIGS. 4A and 4B. Thus, the lesser distance 406 that the fluid drop 408 has to travel in FIG. 4A means that the media 110 will have moved less from left to right while all parts of the drop 408 land on the media 110. By comparison, the greater distance 407 that the fluid drop 410 has to travel in FIG. 4B means that the media 110 will have moved more from left to right while all parts of the drop 408 land on the media 110.

The distance 406 is said to be the desired minimal distance between the fluid-ejection mechanism 402 and the media 110. The distance 406 may be the smallest distance that can be achieved between the fluid-ejection mechanism 402 and the media 110, for instance. For example, during movement of the media 110 from left to right as indicated by the arrow 112, nominal fluttering of the media 110 may occur. To ensure that the media 110 does not come into contact with the fluid-ejection mechanism 402 during such fluttering, the desired minimal distance 406 is maintained between the mechanism 402 and the media 110. As another example, the distance 406 may be the smallest distance that can be maintained between the fluid-ejection mechanism 402 and the media 110, owing to manufacturing and other tolerances of the fluid-ejection device 100 and the media 110 as a whole.

However, maintaining the desired minimal distance 406 between the fluid-ejection mechanism 402 and the media 110 can still result in the media 110 contacting the mechanism 402, when the media 110 cockles or wrinkles as a result of moisture applied to the media 110. The fluid-ejection mechanism 402 may become damaged as a result. At the very least, fluid-ejection quality becomes impaired when cockling or wrinkling of the media 110 causes the media 110 to come into contact with the fluid-ejection mechanism 402.

Figure 5B:
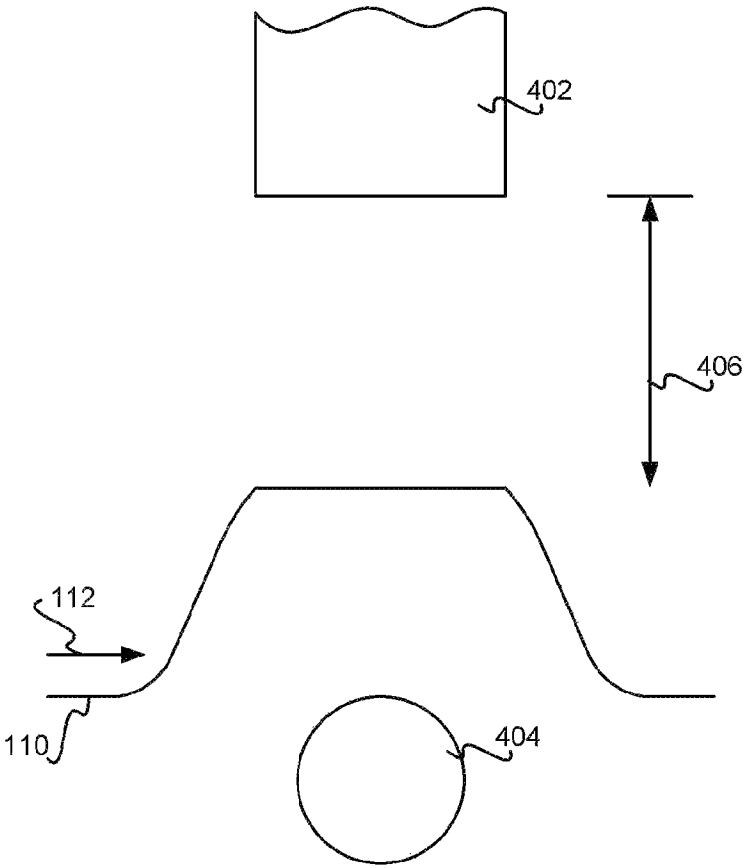
FIGS. 5A and 5B are diagrams depicting how cockling or wrinkling of media can cause the media to contact a fluid-ejection mechanism, and how this problem can be overcome, according to an embodiment of the present disclosure.
Figure 5A:
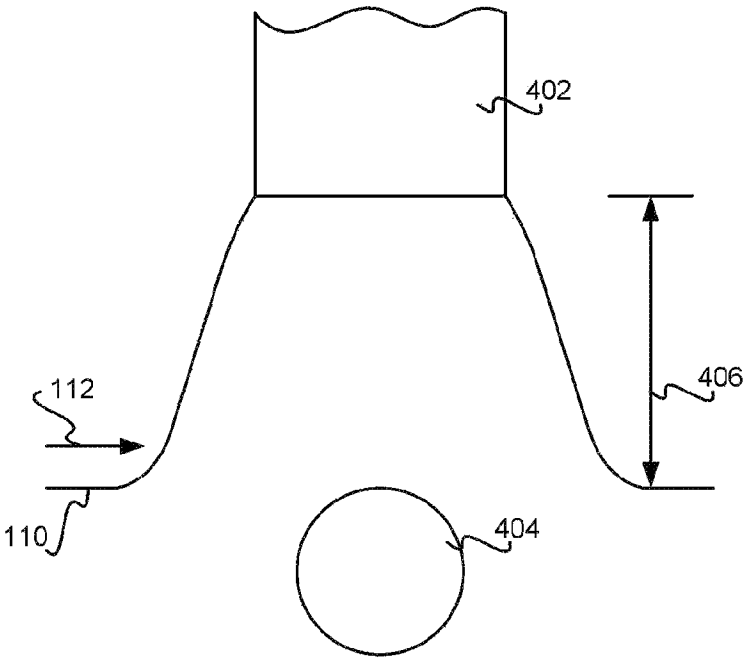

FIG. 5A shows how cockling or wrinkling of the media 110 resulting from moisture being applied to the media 110 can cause the media 110 to contact the fluid-ejection mechanism 402, according to an embodiment of the disclosure. In FIG. 5A, the media 110 moves from left to right, as indicated by the arrow 112. The media 110 has expanded—i.e., it has cockled or wrinkled—within the print zone between the fluid-ejection mechanism 402 and the roller 406, such that the media 110 has come into contact with the fluid-ejection mechanism 402. It is noted that but for the cockling or wrinkling of the media 110, the minimal distance 406 between that would otherwise separate the media 110 from the fluid-ejection mechanism 402 in FIG. 5A (as in FIG. 4A) has been reduced to zero.

To overcome this problem, the spacing between the fluid-ejection mechanism 402 and the roller 404 is adjusted to maintain the desired minimal distance 406 between the mechanism 402 and the media 110, while preventing the media 110 from coming into contact with the mechanism 402. FIG. 5B shows how the spacing between the fluid-ejection mechanism 402 and the roller 404 is adjusted in this respect to overcome the problem described in relation to FIG. 5A, according to an embodiment of the disclosure. The distance between the fluid-ejection mechanism 402 and the roller 404 has been increased in FIG. 5B as compared to in FIG. 5A. As a result, the distance between the fluid-ejection mechanism 402 and the media 110 is maintained at the desired minimal distance 406 in FIG. 5B, as in FIG. 4A. When the cockling or wrinkling ceases, the distance between the fluid-ejection mechanism 402 and the roller 404 may again be decreased as in FIGS. 4A and 5A. As noted above, the fluid-ejection mechanism 402 is itself movable towards and away from (i.e., in relation to) the roller 404, such that moving the mechanism 402 correspondingly adjusts the spacing between the mechanism 402 and the roller 404.

It is noted that the FIG. 5B exaggerates the cockling or wrinkling effect resulting from moisture applied to the media 110, for illustrative clarity and convenience. That is, in FIG. 5, the media 110 is depicted as being completely lifted away from the roller 404. However, in actuality, the media 110 lifts away from the roller 404 at just some locations along the roller 404, but more generally the majority of the media 110 remains in contact with the roller 404.

The fluid-ejection mechanisms 102 of the fluid-ejection device 100 of FIG. 1 may be independently movable towards and from their corresponding rollers 104. As such, the distance of one fluid-ejection mechanism from its corresponding roller can be adjusted while the distance of another fluid-ejection mechanism from its corresponding roller remains constant. In another embodiment, the fluid-ejection mechanisms 102 may be movable towards and from their corresponding rollers 104 as a group. As such, adjusting the distance of one fluid-ejection mechanism from its corresponding roller causes corresponding adjustments to the distances of the other fluid-ejection mechanisms from their corresponding rollers.

It is further noted that wrinkling or cockling of a portion of the media 110 tends to increase with time after sufficient moisture has been applied on this portion of the media 110. For example, in FIG. 1, if the fluid-ejection mechanism 102C ejects fluid onto a given portion of the media 110, the wrinkling or cockling of this media portion may be greater by the time the portion of the media 110 reaches the fluid-ejection mechanism 102E, as compared to when the portion of the media 110 earlier reached the fluid-ejection mechanism 102D. As such, the degree of adjustment of a given fluid-ejection mechanism may be modified based on how far away a given fluid-ejection mechanism is from the fluid-ejection mechanism that, by virtue of ejecting sufficient fluid onto the media 110, has applied moisture to the media 110.

Per the previous example, then, it is presumed that the fluid-ejection mechanism 102C ejects sufficient fluid onto a portion of the media 110 to apply moisture to this portion of the media 110 while this media portion moves through the print zone between the mechanism 102C and its corresponding roller 104C. The fluid-ejection mechanism 102D and its corresponding roller 104D also define a print zone, as does the fluid-ejection mechanism 102E and its corresponding roller 104E. It is said that the fluid-ejection mechanisms 102D and 102E and the rollers 104D and 104E are located after the fluid-ejection mechanism 102C and the roller 102C. This is because fluid is ejected onto a given media portion within the print zone defined between the mechanism 102C and the roller 102C before fluid is ejected onto this media portion within the print zones defined between the mechanism 102D and the roller 102F and between the mechanism 102E and the mechanism 104E.

In this example, then, the distance between the fluid-ejection mechanism 102D and the roller 104D is increased less than the distance between the fluid-ejection mechanism 102E and the roller 104E is increased to counteract the cockling or wrinkling caused by the fluid ejected by the fluid-ejection mechanism 102C. This is because the print zone defined between the fluid-ejection mechanism 102D and the roller 104D is closer to (and in fact is immediately adjacent to) the print zone defined between the fluid-ejection mechanism 102C and the roller 104C. By comparison, the print zone defined between the fluid-ejection mechanism 102E and the roller 104E is farther from the print zone defined between the fluid-ejection mechanism 102C and the roller 104C. The print zone defined between the fluid-ejection mechanism 102E and the roller 104E is in fact separated from the print zone defined between the fluid-ejection mechanism 102C and the roller 104C by the print zone defined between the fluid-ejection mechanism 102D and the roller 104D.

In general, the spacing between a fluid-ejection mechanism and its corresponding roller is adjusted to maintain a desired minimal distance between the fluid-ejection mechanism and the media 110, while preventing the fluid-ejection mechanism from contacting the media 110 due to expansion (e.g., cockling or wrinkling) of the media 110. In some situations, the spacing between the fluid-ejection mechanism and its corresponding roller may be increased to maintain this desired minimal distance, particularly where cockling or wrinkling of the media 110 has occurred—that is, where the moisture on the media is 110 is at least substantially sufficient to cause the media 110 to wrinkle or cockle towards the fluid-ejection mechanism. In other situations, the spacing between the fluid-ejection mechanism and its corresponding roller may be decreased to maintain this desired minimal distance, particularly where cockling or wrinkling of the media 110 no longer occurs—that is, where the moisture on the media 110 is at least substantially insufficient to cause the media 110 to wrinkle or cockle towards the fluid-ejection mechanism.

Method and Rudimentary Roller-Based Fluid-Ejection Device

Figure 6:
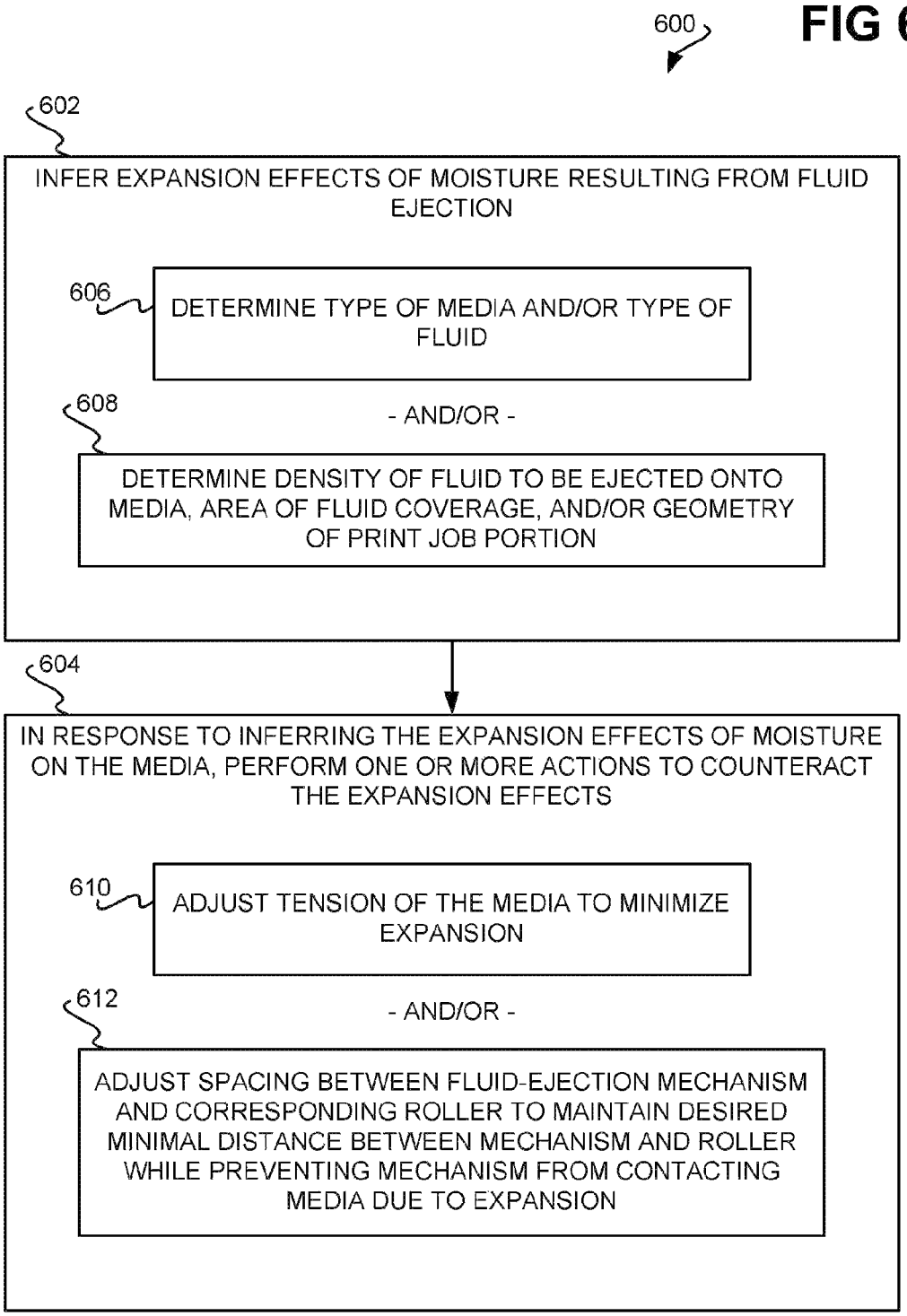
FIG. 6 is a flowchart of a method, according to an embodiment of the present disclosure.

FIG. 6 shows a method 600, according to an embodiment of the disclosure. Generally, the method 600 infers the expansion effects of moisture on media, resulting from ejection of fluid by a roller-based fluid-ejection device onto the media within a print zone in accordance with a portion of a print job (602). The inference of the expansion effects of moisture on the media in part 602 may be performed before the fluid causing the moisture to be applied on the media is actually ejected in one embodiment, or after the fluid is ejected in another embodiment. In response to inferring the expansion effects of moisture on the media, the method 600 performs one or more actions to counteract the expansion effects of moisture on the media.

Part 602 of the method 600 can be achieved by performing part 606 and/or part 608. In at least some embodiments, the expansion effects of the moisture applied to the media may not be directly detectable. Therefore, parts 606 and 608 are performed to effectively indirectly detect the expansion effects of the moisture applied to the media, by considering aspects, attributes, and/or parameters that are known and/or that are directly detectable.

The expansion effects of moisture on the media can be inferred at least in part by determining the type of the media onto which the fluid is to be ejected within the print zone in accordance with a portion of the print job, and/or the type of fluid that is to be ejected (606). The type of media and/or the type of fluid may be directly detected, or may be specified by a user. The type of media affects the expansion effects of moisture on the media. For example, a relatively thin, paper-based media such as newsprint expands as a result of moisture more than a relative thick, non-paper-based media like polyester films such as Mylar® polyester film available from DuPont Teijin Films, of Chester, Va. Similarly, the type of fluid affects the expansion effects of moisture on the media. Some inkjet-printing device inks, for example, have more liquid content than other inkjet-printing device inks, and thus result in more moisture being applied on media for a given volume of ink.

The expansion effects of moisture on the media can also be inferred at least in part by determining the density of the fluid to be ejected onto the media within the print zone in accordance with a portion of the print job, the area of fluid coverage of the media within the print zone onto which the fluid is to be ejected in accordance with the portion of the print job, and/or the geometry of this portion of the print job (608). These aspects, attributes, and parameters can be determined by analyzing the print job that is to control the ejection of fluid onto the media. The geometry of the portion of the print job in accordance with which fluid is ejected onto the media within the print zone can affect the expansion effects of moisture on the media. For instance, certain geometries may result in greater expansion of the media than other geometries. The density of the fluid can include either or both the physical density of the fluid itself, expressed in units of weight per unit of volume of fluid (e.g., grams per cubic centimeter), as well as the amount of fluid being ejected onto the media, expressed in units of weight per unit of surface area of the media (e.g., grams per square centimeter).

Furthermore a given portion of the print job may result in relatively large coverage of fluid onto the media within the print zone, and/or a relatively high density of the fluid onto the media. In either such case, the amount of fluid ejected onto the media within the print zone is greater than if there were lesser fluid coverage and/or a lower fluid density. For example, relatively large fluid coverage can occur when the portion of the print job specifies that an entire portion of media within the print zone is to have fluid ejected thereon, as opposed to less than the entire portion of the media. As another example, relatively high fluid density can occur when the portion of the print job specifies that more intense colors be printed on the media within the print zone, as opposed to less intense colors. As such, fluid density and fluid coverage area affects the expansion effects of moisture on the media.

Part 604 of the method 600 can be achieved by performing part 610 and/or part 612. As has been described above, the tension of the media while the media is being rolled through the fluid-ejection device can be adjusted to minimize the expansion of the media resulting from ejection of the fluid onto the media within the print zone (610). As has also been described above, the spacing between a selected fluid-ejection mechanism and a selected roller can be adjusted to maintain a desired minimal distance between the selected fluid-ejection mechanism and the media, while preventing the selected mechanism from contacting the media due to expansion of the media (612).

Figure 7:
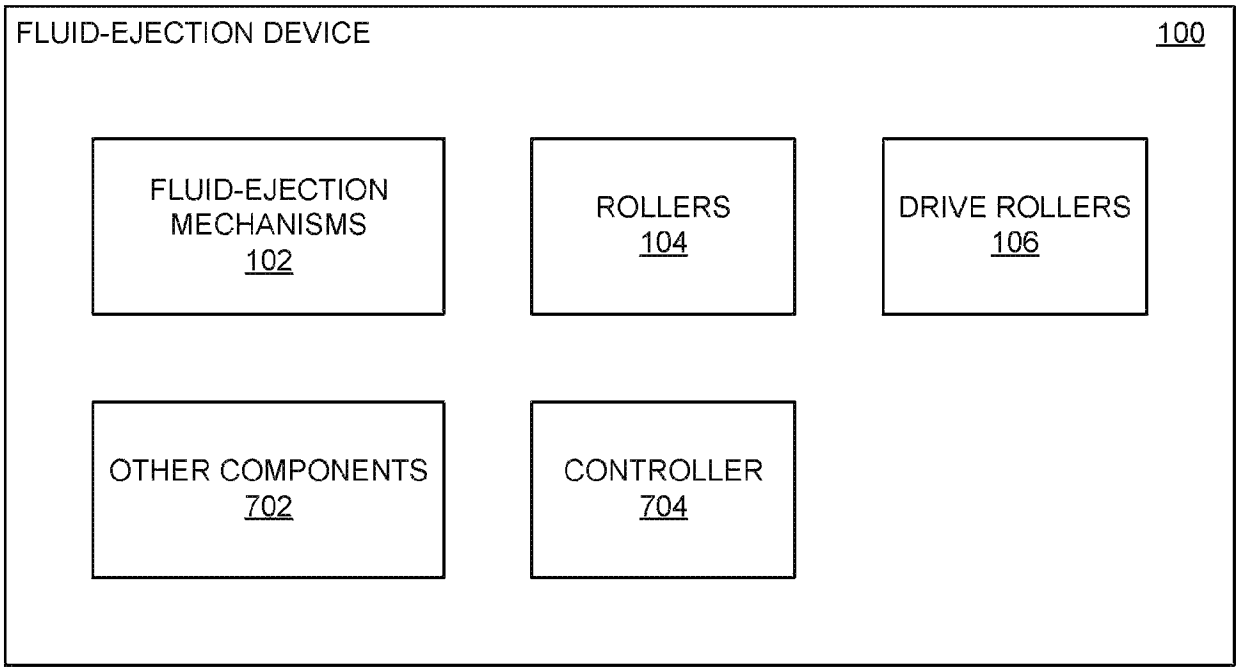
FIG. 7 is a block diagram of a fluid-ejection device, according to an embodiment of the present disclosure.

In conclusion, FIG. 7 shows a block diagram of a rudimentary roller-based fluid-ejection device 100, according to an embodiment of the disclosure. The fluid-ejection device 100 includes the fluid-ejection mechanisms 102, the rollers 104, and the drive rollers 106 that have been described. The fluid-ejection device 100 can include other components 702, such as the rollers 108 that have been described in relation to FIG. 1. The fluid-ejection device 100 further includes a controller 704.

The fluid-ejection device 100 may be an inkjet-printing device, which is a device, such as a printer, that ejects ink onto media, such as paper, to form images, which can include text, on the media. The fluid-ejection device 100 is more generally a fluid-ejection precision-dispensing device that precisely dispenses fluid, such as ink. The fluid-ejection device 100 may eject pigment-based ink, dye-based ink, another type of ink, or another type of fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

The controller 704 may be implemented in software, hardware, or a combination of software and hardware. The controller 704 performs the method 600 of FIG. 6 that has been described. As such, the controller 704 can infer the expansion effects on media resulting from ejection of fluid onto the media within print zones in accordance with a portion of a print job. The controller 704 can further responsively perform actions to counter the expansion effects of such moisture on the media. In this respect, the controller 704 can be considered the means that performs this functionality.

Alternative Embodiments and Conclusion

It is noted that embodiments of the present disclosure have been largely described in relation to a fluid-ejection device that is a roller-based fluid-ejection device, such as the roller-based fluid-ejection device 100 of FIG. 7. However, other embodiments of the disclosure can pertain to non-roller-based fluid-ejection devices. A roller-based fluid-ejection device is one in which media is moved past one or more unmotorized rollers in relation to which one or more corresponding print zones are defined in conjunction with one or more corresponding fluid-ejection mechanisms.

The media is caused to move past such unmotorized rollers by motorized drive rollers of the roller-based fluid-ejection device. Specifically, there are at least two motorized drive rollers in a typical roller-based fluid-ejection device: a first motorized drive roller (e.g., the drive roller 106B of FIG. 1) that pulls the media, and a second motorized drive roller (e.g., the drive roller 106A of FIG. 1) that pushes the media. The push and pull actions of the drive rollers create tension on the media so that the media remains at least substantially flat (but for moisture-related expansion effects) while being rolled through the print zones.

In a roller-based fluid-ejection device, the media itself is typically supplied as a roll that prior to having fluid ejected thereon is rolled on a supply roll, and that after having fluid ejected thereon is rolled on a take-up roll. As such, by comparison, a non-roller-based fluid-ejection device does not typically roll media from a supply roll through the various print zones and onto a take-up roll. Furthermore, non-roller-based fluid-ejection devices typically do not employ at least two motorized drive rollers that push and pull the media to create tension on the media. Non-roller-based fluid-ejection devices also typically do not employ unmotorized rollers that together with corresponding fluid-ejection mechanisms define print zones within which fluid is actually ejected onto the media.

We claim:

1. A method comprising:

inferring expansion effects of moisture on media resulting from ejection of fluid by a fluid-ejection device onto the media within a print zone in accordance with a portion of a print job; and in response to inferring the expansion effects of moisture on the media, adjusting tension of the media while the media is being moved through the fluid-ejection device to minimize expansion of the media resulting from the ejection of the fluid onto the media within the print zone;

wherein adjusting the tension of the media moved through the fluid-ejection device comprises adjusting a rotational speed of a first drive roller of the fluid-ejection device in relation to a rotational speed of a second drive roller of the fluid-ejection device;

wherein the first drive roller is located within the fluid-ejection device in relation to the media after the media has had fluid ejected thereon within the fluid-ejection device, and the second drive roller is located within the fluid-ejection device in relation to the media before the media has had fluid ejected thereon within the fluid-ejection device; and wherein the first and the second drive rollers are different than a roller defining the print zone.

2. The method of claim 1, wherein the expansion effects of moisture on the media is selected from the group consisting of:

expansion of the media in a direction perpendicular to a direction of movement of the media through the fluid-ejection device and parallel to a surface of the media onto which the fluid is ejected;

expansion of the media in a direction parallel to the direction of movement of the media through the fluid-ejection device and parallel to the surface of the media onto which the fluid is ejected; and expansion of the media in a direction perpendicular to the direction of movement of the media through the fluid-ejection device and perpendicular to the surface of the media onto which the fluid is ejected.

3. The method of claim 1, wherein inferring the expansion effects of moisture on the media resulting from the ejection of the fluid onto the media within the print zone in accordance with the portion of the print job is selected from the group consisting of:

determining a type of the media onto which the fluid is to be ejected within the print zone in accordance with the portion of the print job, such that the expansion effects of moisture on the media are affected by the type of the media;

determining a type of the fluid to be ejected onto the media within the print zone in accordance with the portion of the print job, such that the expansion effects of moisture on the media are affected by the type of the fluid;

determining a density of the fluid to be the ejected onto the media within the print zone in accordance with the portion of the print job, such that the expansion effects of moisture on the media are affected by the density of the fluid;

determining an area of fluid coverage of the media within the print zone onto which the fluid is to be ejected in accordance with the portion of the print job, such that the expansion effects of moisture on the media are affected by the area of fluid coverage; and determining a geometry of the portion of the print job in accordance with which fluid is to be ejected onto the media within the print zone, such that the expansion effects of moisture on the media are affected by the geometry.

4. The method of claim 1, wherein the fluid-ejection device has a roller and a fluid-ejection mechanism between which the print zone is defined, wherein adjusting the tension of the media while the media is being moved through the fluid-ejection device comprises decreasing the tension of the media while the media is being moved through the fluid-ejection device.

5. The method of claim 1, wherein the fluid-ejection device has a roller and a fluid-ejection mechanism between which the print zone is defined, wherein adjusting the tension of the media while the media is being moved through the fluid-ejection device comprises increasing the tension of the media while the media is being moved through the fluid-ejection device.

6. The method of claim 1, wherein performing the action to counteract the expansion effects of moisture on the media comprises:

moving a selected fluid-ejection mechanism of the fluid-ejection to maintain a minimal distance between the selected fluid-ejection mechanism and the media while preventing the selected fluid-ejection mechanism from contacting the media due to expansion of the media.

7. The method of claim 1, wherein inferring the expansion effects of moisture on the media resulting from the ejection of the fluid onto the media within the print zone in accordance with the portion of the print job further comprises:

determining a type of the media onto which the fluid is to be ejected within the print zone in accordance with the portion of the print job, such that the expansion effects of moisture on the media are affected by the type of the media.

8. The method of claim 1, wherein inferring the expansion effects of moisture on the media resulting from the ejection of the fluid onto the media within the print zone in accordance with the portion of the print job further comprises:

determining a type of the fluid to be ejected onto the media within the print zone in accordance with the portion of the print job, such that the expansion effects of moisture on the media are affected by the type of the fluid.

9. The method of claim 1, wherein inferring the expansion effects of moisture on the media resulting from the ejection of the fluid onto the media within the print zone in accordance with the portion of the print job further comprises:

determining a density of the fluid to be the ejected onto the media within the print zone in accordance with the portion of the print job, such that the expansion effects of moisture on the media are affected by the density of the fluid.

10. The method of claim 1, wherein inferring the expansion effects of moisture on the media resulting from the ejection of the fluid onto the media within the print zone in accordance with the portion of the print job further comprises:

determining an area of fluid coverage of the media within the print zone onto which the fluid is to be ejected in accordance with the portion of the print job, such that the expansion effects of moisture on the media are affected by the area of fluid coverage.

11. The method of claim 1, wherein inferring the expansion effects of moisture on the media resulting from the ejection of the fluid onto the media within the print zone in accordance with the portion of the print job further comprises:

determining a geometry of the portion of the print job in accordance with which fluid is to be ejected onto the media within the print zone, such that the expansion effects of moisture on the media are affected by the geometry.

12. A fluid-ejection device comprising:

a fluid-ejection mechanisms corresponding to a print zone; and, a controller to cause an action to be performed to counteract expansion effects on media resulting from ejection of fluid onto the media within the print zone in accordance with a portion of a print job, wherein the action is selected from the group consisting of:

a first action comprising adjusting tension of the media while the media is being moved through the fluid-ejection device to minimize expansion of the media resulting from the ejection of the fluid onto the media within the print zone, wherein adjusting the tension of the media moved through the fluid-ejection device comprises adjusting a rotational speed of a first drive roller of the fluid-ejection device in relation to rotational speed of a second drive roller of the fluid-ejection device;

wherein the first drive roller is located within the fluid-ejection device in relation to the media after the media has had fluid ejected thereon within the fluid-ejection device, and the second drive roller is located within the fluid-ejection device in relation to the media before the media has had fluid ejected thereon within the fluid-ejection device; and wherein the first and the second drive rollers are different than a roller defining the print zone; and a second action comprising adjusting moving the fluid-ejection mechanism to maintain a minimal distance between the selected fluid-ejection mechanism and the media while preventing the fluid-ejection mechanism from contacting the media due to expansion of the media.

13. The fluid-ejection device of claim 12, further comprising a plurality of drive rollers, wherein the controller is to adjust the tension of the media by adjusting a speed of a first drive roller in relation to a speed of a second drive roller.

14. A fluid-ejection device comprising:

an unmotorized roller;

a fluid-ejection mechanism opposite the unmotorized roller and movable towards and away from the unmotorized roller, a print zone defined between the fluid-ejection mechanism and the unmotorized roller;

a plurality of motorized drive rollers, such that media is moved through the fluid-ejection device by the motorized drive rollers causing the media to roll through the fluid-ejection device through the print zone; and, a controller to perform one or more actions to counteract the expansion effects of moisture on the media resulting from ejection of fluid onto the media within the print zone by the fluid-ejection mechanisms in accordance with a portion of a print job, wherein the actions are selected from the group consisting of:

adjusting tension of the media while the media is being moved through the fluid-ejection device to minimize expansion of the media resulting from the ejection of the fluid onto the media within the print zone, the tension adjusted by adjusting the rotational speed of a first drive roller of the fluid-ejection device in relation to a rotational speed of a second drive roller of the fluid-ejection device;

wherein the first drive roller is located within the fluid-ejection device in relation to the media after the media has had fluid ejected thereon within the fluid-election device, and the second drive roller is located within the fluid-ejection device in relation to the media before the media has had fluid ejected thereon within the fluid-ejection device; and wherein the first and the second drive rollers different than a roller defining the print zone;

moving the fluid-ejection mechanism to adjust a spacing between the fluid-ejection mechanism and the unmotorized roller to maintain a minimal distance between the fluid-ejection mechanism and the media while preventing the fluid-ejection mechanism from contacting the media due to expansion of the media.

* * * * *

UNITED STATES PATENT AND TRADEMARK OFFICE

CERTIFICATE OF CORRECTION

PATENT NO. : 8,696,082 B2
APPLICATION NO. : 13/260216
DATED : April 15, 2014
INVENTOR(S) : Whitney Elaine Loper et al.

It is certified that error appears in the above-identified patent and that said Letters Patent is hereby corrected as shown below:

In the claims

In column 11, line 39, in Claim 3, after “be” delete “the”.

In column 12, line 30, in Claim 9, after “be” delete “the”.

In column 14, line 19, in Claim 14, delete “fluid-election” and insert -- fluid-ejection --, therefor.

Signed and Sealed this
Twenty-sixth Day of April, 2016

Michelle K. Lee

Michelle K. Lee
*Director of the United States Patent and Trademark Office*